US005171628A

United States Patent [19]

Arvedson et al.

[11] Patent Number: 5,171,628

[45] Date of Patent: Dec. 15, 1992

[54] LOW CREEP POLYPROPYLENE TEXTILES

[75] Inventors: Marsha M. Arvedson, Houston; Gerhardt E. Wissler, Seabrook, both of Tex.

[73] Assignee: Exxon Chemical Patents Inc., Linden, N.J.

[21] Appl. No.: 357,146

[22] Filed: May 25, 1989

[51] Int. Cl.[5] ..... D03D 3/00

[52] U.S. Cl. ..... 428/224; 428/225

[58] Field of Search ..... 525/210; 428/224, 225

[56] References Cited

U.S. PATENT DOCUMENTS 3,341,626 9/1967 Peterkin ..... 260/897
3,361,849 1/1968 Cramer et al. ..... 525/210
4,076,670 2/1978 Godfrey ..... 260/27 R

*Primary Examiner*—James J. Bell
*Attorney, Agent, or Firm*—M. B. Kurtzman; Catherine L. Bell

[57] ABSTRACT

Low creep polypropylene textiles are disclosed which comprise a blend of isotactic polypropylene with 10–30 weight percent of a resin obtained by hydrogenating polymerized olefinically unsaturated monomers derived from petroleum cracking, e.g., polydicyclopentadiene. The hydrocarbon resin has a weight average molecular weight of from 500 to 1000 and a glass transition temperature of from 40° C. to 90° C. The blend exhibits creep resistance at ambient temperatures and has a glass transition temperature greater than 20° C. The textile blend is useful in carpet, drapery and other applications wherein creep resistance and resiliency are desirable.

6 Claims, 3 Drawing Sheets

CREEP RESISTANCE - 40% LOADING

CREEP RESISTANCE - 20% LOADING

LOW CREEP POLYPROPYLENE TEXTILES

FIELD OF THE INVENTION

This invention relates to low creep polypropylene textiles, and more particularly to fibers made from a blend of polypropylene and hydrogenated hydrocarbon resins.

BACKGROUND OF THE INVENTION

Isotactic polypropylene is an essentially linear, highly crystalline polymer. It is well known commercially for its high tensile strength, stiffness and hardness. An important use of polypropylene commercially is as filament, e.g., rope, cordage, webbing and carpeting. Relative to textiles made from nylon or polyester, however, polypropylene is deficient in resiliency and creep resistance. Resiliency is the ability of a fiber to recover from having been bent over, for example, the ability of carpet filament or staple to return to its original shape after being under a piece of furniture. Unfortunately, polypropylene fibers accept a anything except very dense carpets. Creep is the continuous elongation over an extended period of time under a load. In drapery applications, the creep of polypropylene is generally such that the fabric will undergo dimensional deformation with time. In polypropylenes used in textile applications, the same creep can lead to a loss of fabric strength.

Nylon and polyester are often favored over polypropylene in applications requiring resiliency and creep resistance. Nylon and polyester, like polypropylene, are crystalline polymers which, in their solid state, have both crystalline and amorphous phases. In contrast to polypropylene, however, nylon and polyester have considerably higher glass transition temperatures, generally about 100° C. and 150° C., respectively. Therefore, at normal, ambient use temperatures, the amorphous phase in polyester and nylon is effectively "frozen" and the molecular chains therein are generally prevented from stress relaxing. Polypropylene has a glass transition temperature of about 0° C. At ambient temperatures it is above its glass transition temperature. Thus chains in the amorphous phase are able to move, with the result that creep and poor resiliency are manifested.

It is known from U.S. Pat. No. 3,361,849 to Cramer, et al., to employ blends of polypropylene with from about 1% to about 60% of hydrogenated hydrocarbon polymers in applications for making self-supporting film stated to possess outstanding physical properties, heat sealability, and light stability. In Example 12 of this patent, for example, there is described a film made from 80 parts of isotactic polypropylene and 20 parts of a hydrogenated hydrocarbon polymer having a softening point of 105° C., an average molecular weight of about 1170, and iodine value of 25, and prepared by hydrogenating the resinous catalytic polymerization product of unsaturated monomers derived from cracked petroleum and composed essentially of dienes and reactive olefins.

It is known from U.S. Pat. No. 3,341,626 to Peterkin, to use a hot melt adhesive including a blend of atactic polypropylene, isotactic polypropylene, and terpene resins. Bonds formed by application of this hot melt adhesive composition are stated to have resistance to creep defined as the susceptibility of the bond to deform at elevated temperatures, e.g., 75° C.

Hot melt adhesive blends made from polyethylene, polypropylene, and a tackifying agent are known from U.S. Pat. No. 4,076,670 to Godfrey. These adhesives are stated to have creep resistance as evaluated over the temperature range of 0° F. to 35° F.

SUMMARY OF THE INVENTION

The present invention provides a polypropylene textile with improved resiliency and resistance to creep at ambient temperatures. The improved properties of the polypropylene textile are obtained by forming the textile from isotactic polypropylene blended with a minor proportion of a hydrogenated hydrocarbon essential to obtaining the improved resiliency and creep resistance of the polypropylene blend. These essential properties include a weight average molecular weight of from 500 to 1000 as measured by gel permeation chromatography using polyisobutylene standards and a glass transition temperature as measured by differential scanning calorimetry of from 40° C. to 90° C. Desirably, the ratio of weight average molecular weight to number average molecular weight should be about 2 to 3. The hydrogenated hydrocarbon resin is, for example, the hydrogenated product of polymerized cyclic diolefins.

In one aspect, the invention provides a textile which includes an intimate blend of isotactic polypropylene and from 10 to 30 weight percent hydrogenated hydrocarbon resin. The hydrogenated hydrocarbon resin is compatible with the polypropylene. The hydrogenated hydrocarbon resin has a weight average molecular weight of from 500 to 1000 and a glass transition temperature of from 40° C. to 90° C. and is obtained by the hydrogenation of polymerized olefinically unsaturated monomers derived from petroleum cracking. The blend exhibits creep resistance and resiliency at ambient temperatures, i.e., 10° C.–30° C., and has a glass transition temperature greater than 20° C., preferably greater than 25° C.

In another aspect, the invention provides a polypropylene ribbon yarn exhibiting resiliency and resistance to creep. The yarn comprises an intimate blend of isotactic polypropylene and preferably from 15–20 parts by weight of a hydrogenated hydrocarbon resin per 100 parts by weight of the polypropylene. The hydrogenated hydrocarbon resin comprises the hydrogenated product of polymerized cyclic diolefin, and has a weight average molecular weight of from 500 to 1000, and a glass transition temperature of from 40° C. to 90 C. The blend has a glass transition temperature of at least 20.C and a melt flow ratio of from 0.1 to 10. The blend is formed into ribbon yarn from split sheet or thin ribbon 24 extrusion and is drawn at a draw ratio of from 1:1 to 20:1.

DETAILED DESCRIPTION OF THE PREFERRED EMBODIMENTS

Figure 1B:
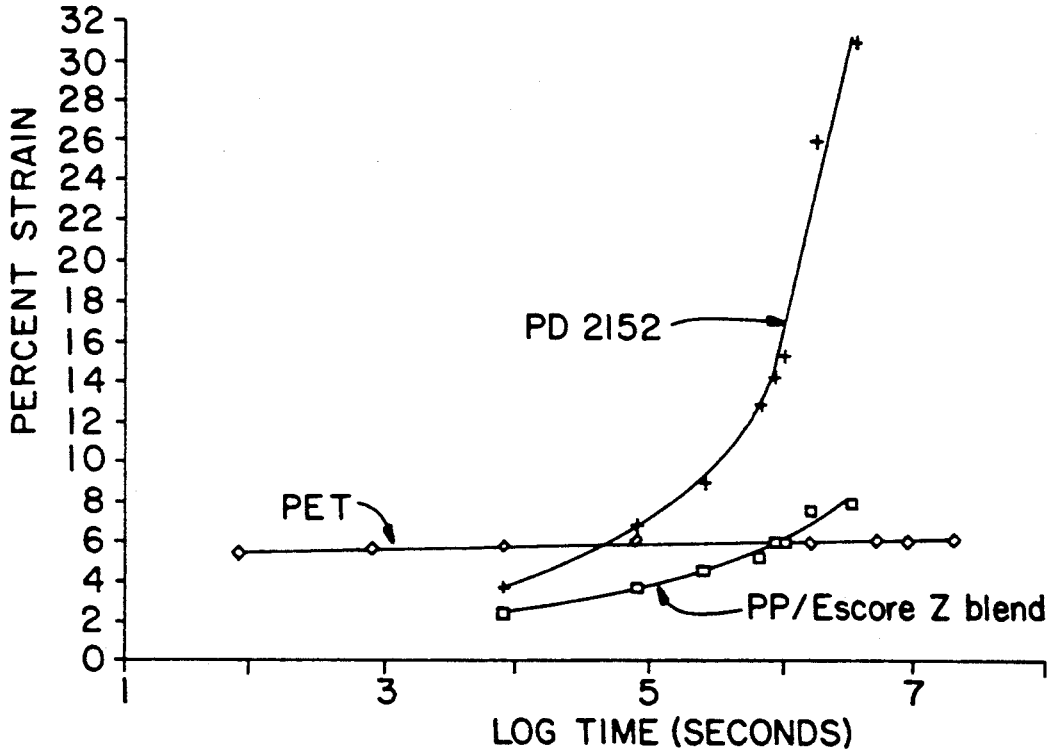
FIG. 1B is a graphical illustration of the creep resistance of the ribbon yarns of FIG. 1A at 40% loading as described in Example 1.

The polypropylene used in the textile according to the present invention is any conventional isotactic polypropylene suitable for use in textiles. Textile grade polypropylenes typically have a melt-flow ratio of from about 0.1 to about 10, a weight average molecular weight of from about 600,000 to about 250,000, and a ratio of weight average to number average molecular weight of from about 4 to about 10. As used herein melt flow rate (MFR) is determined according to the procedures of ASTM D1238, condition 230° C., 2.160 kg (condition L). The polypropylene will typically also contain conventional additives such as antioxidants, light and heat stabilizers, and the like.

The hydrogenated hydrocarbon resin employed in the textile blend of the present invention is a hydrogenated amorphous polymer of one or more hydrocarbon monomers. The resin has a higher glass transition temperature (Tg) than the polypropylene and is compatible therewith in the proportions employed so as to be miscible on a molecular scale. The higher Tg of the hydrogenated hydrocarbon resin serves to elevate the Tg of the amorphous regions of the polypropylene in the textile, essentially without adversely affecting the tensile properties of the polypropylene in the crystalline phase. Thus, the resulting polypropylene and resin blend has improved resiliency and creep resistance and equivalent tensile strength and stiffness relative to polypropylene not containing the hydrogenated hydrocarbon resin.

It has been found that the properties of the hydrogenated hydrocarbon resin necessary to obtain this result include the glass transition temperature and the molecular weight distribution. The Tg of the resin must be between 40° C. and 90° C. and the weight average molecular weight (Mw) must be between 500 and 1000. If the Tg is too low, the resulting resiliency and creep resistance of the textile blend is not adequately enhanced. Also, if the weight average molecular weight is too low, "smoking" during blending with the polypropylene at the elevated temperatures required to obtain the necessary dispersion during the forming of the blend into textile fibers can occur. On the other hand, if Mw is too high, the resin may not be sufficiently miscible with the polypropylene. Immiscibility of the resin with the polypropylene will tend to adversely affect the desirable properties of the polypropylene, e.g., tensile strength and hardness.

Hydrogenation of the resin is also important because excessively unsaturated resins will have a yellow color, and will not be resistant to heat and light. The resin should have a bromine number of less than 150 mg/100 gm as measured by ASTM D1159-84.

The hydrocarbon resin is prepared by the hydrogenation of polymerized olefinically unsaturated monomers derived from petroleum cracking, preferably cyclic diolefin, such as, for example, dicyclopentadiene, styrene, alpha-methylstyrene and the like. Such resins, their preparation and hydrogenation are well known in the art and are commercially available under the trade designations, for example, Escorez, Arkon and the like. Particularly preferred are resins obtained in the trade under the designation Escorez 5000 series. The resins are formed by the polymerization of dicyclopentadiene followed by hydrogenation.

The resin and the polypropylene are blended in a proportion of from about 10 to 30 weight percent resin. At least about 10 parts by weight of the resin is required to obtain an improvement in ambient temperature creep resistance and resiliency. An excessive proportion of the resin will generally adversely affect the tensile strength of the textile.

The resin and polypropylene along with any conventional additives, are blended together using conventional equipment and techniques. Conventional additives may include antioxidants, heat stabilizers, light stabilizers and the like in relatively minor proportions. The blend should, however, be essentially free of added blend components such as polyethylene, atactic polypropylene and the like so that the desirable physical and mechanical affected thereby. The desired proportions of the resin and polypropylene may be blended, for example, in mixing extruders, roll mills, Banbury mixers and the like. The blend should be sufficiently mixed to ensure uniform distribution of the resin throughout the polypropylene. The blend is then subsequently processed into textile form, for example, spun fibers or ribbon yarn. Ribbon yarn may be prepared, for example, by extruding the blend into the form of a thin film and subsequently cutting the film into thin strips to form ribbon or by directly extruding the blend into thin ribbon shapes. The fibers are preferably drawn at fibers. Although any suitable drawing temperature may be employed, cold drawing at a temperature from 120° C. to 220° C. is preferred. The fibers can then be processed into conventional textile products such as rope, carpet staple, carpet fiber, fabrics and the like.

The invention is illustrated by way of the examples which follow:

EXAMPLE 1

Figure 1A:
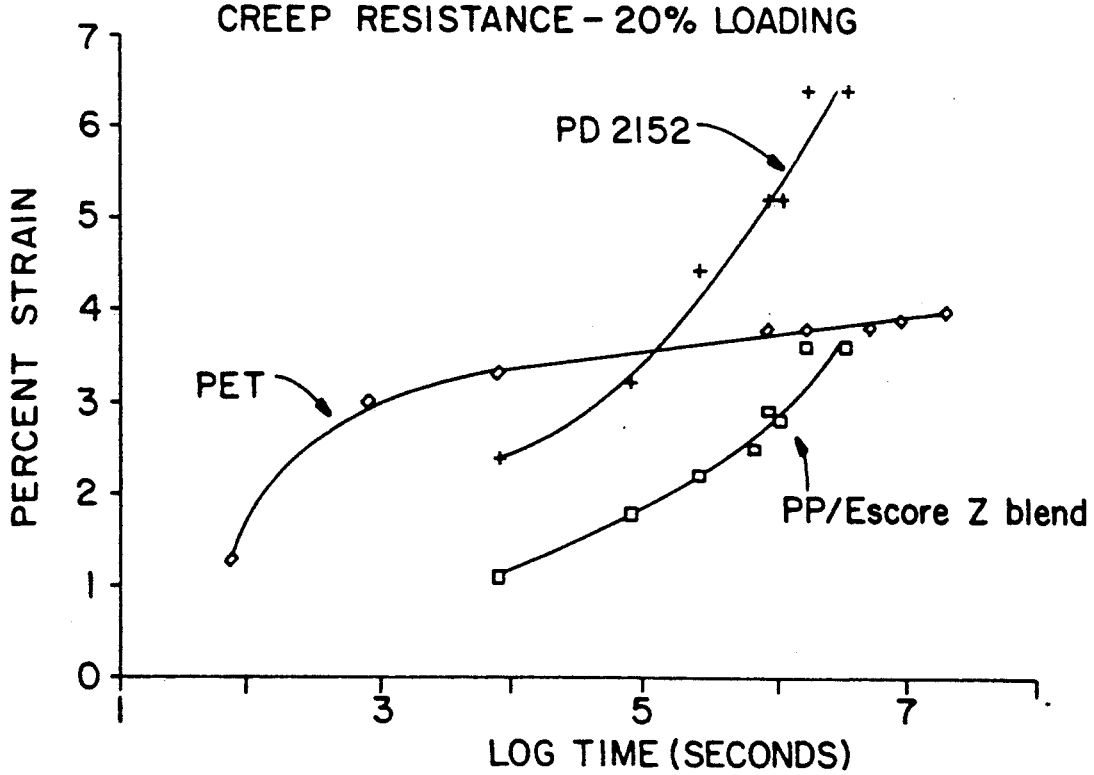
FIG. 1A is a graphical illustration of the creep polypropylene (□-□-□) compared to unmodified polypropylene (+-+-+) and polyethylene terephthalate (◇-◇-◇) as described in Example 1.

Ribbon yarn was prepared from polypropylene blended with Escorez 5340 resin at 12 weight percent of resin. The polypropylene was obtained from Exxon Chemical Company and had a melt flow rate (MFR) of 0.5 {condition 230° C, 2.160 kg}and a Mw of 500,000. The Escorez resin was obtained commercially from Exxon Chemical Company and is a hydrogenated polydicyclopentadiene flake having a Mw of 810 and a Tg of 85° C. The polypropylene/resin blend was prepared by dry blending the two components and then melt compounding using a Herner Pfleiderer extruder with a twin co-rotating, intermeshing screw 1460 mm in length. The temperature of the later zones of the screw was 220° C. The blend was extruded through a 24 hole die which discharged into a water bath and strand cutting system for pelletizing. The resulting blend had a MFR of 1.5 and a Tg of approximately 27° C. as measured at the peak in a plot of loss modulus versus temperature determined using a Polymers Laboratories' dynamic mechanical thermal analyzer {DMTA). The pelletized blend was formed into ribbon yarn by extruding the blend strips to form ribbon. The ribbon was then drawn 7:1 at approximately 180° C. The ribbon yarn was evaluated for creep resistance using weights that were equal to 20% and 40% of the breaking force of the yarn at room temperature. The procedure was repeated for polyethylene terephthalate (PET) and for polypropylene without resin for comparative purposes. The comparative polypropylene was obtained from Exxon Chemical Company under the designation PD2152 and had a MFR of 2.3 and a Mw of approximately 360,000. The PET was a typical textile grade fiber produced by Celanese. The resulting data seen in Figs. 1A and 1B show that the Escorez resin-modified polypropylene exhibited a much greater creep resistance than the unmodified polypropylene. The creep resistance of the resin-modified polypropylene was comparable to that of the PET and initially superior thereto.

EXAMPLE 2

Figure 2:
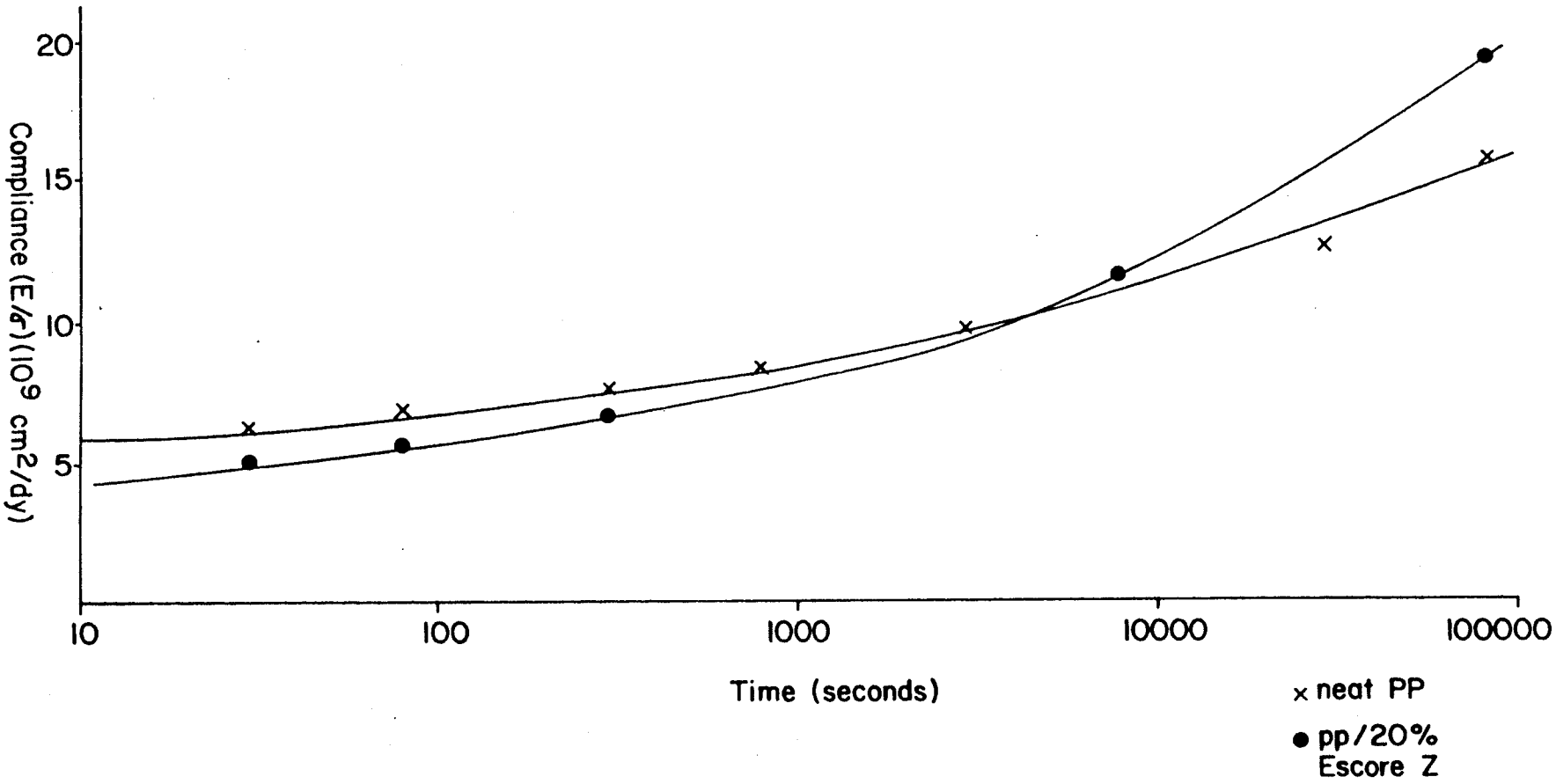
FIG. 2 is a graphical illustration of the creep compliance of an injection molded specimen of resin-modified polypropylene (·····) compared to unmodified polypropylene (x-x-x) as described in Example 2.

20 weight percent Escorez ECR356B resin was blended with PD020 polypropylene obtained from Exxon Chemical Company at approximately 230° C. using a Reiffenhauser extruder with a 70 mm, 24:1 single screw with Maddox mixing section. The blend was extruded into strands and pelletized. The blend had a MFR of 0.6 and a Tg of 28° C. as measured by DMTA. The blend was subsequently injection molded into a 16.3 cm long by 1.3 cm wide by 3 mm thick dog bone shape which was then mill cut into a 10 cm long by 5 mm wide dog bone shape. A stress of 9 MPa was put on the molded piece and the elongation at 23° C. was recorded as a function of time. The procedure was repeated with the PD020 polypropylene without the Escorez additive except that an imposed stress of 7.4 MPa was used. The stress chosen for each material was such as to produce a 100 second creep strain of 0.5%. The results are illustrated in FIG. 2 which is a plot of creep compliance vs. time where the compliance is the strain e at some time divided by the stress $\sigma$ on the sample. The neat polypropylene exhibited a greater creep compliance, i.e., lower creep resistance, than the polypropylene/resin blend over the first hour. Furthermore, the PD020 polypropylene/Escorez ECR563B blend exhibits tensile strength and stiffness equivalent to that of the unmodified PD020 polypropylene as shown in the table below.

| Property | ASTM | PD020 Poly-propylene | 80/20 Blend PD020/ ECR356B |
|---|---|---|---|
| Tensile strength @ yield, psi | D-638 | 4900 | 5000 |
| Tensile strength @ break, psi | D-638 | 1600 | 1900 |
| Secant Flexural Modulus, psi | D-790 | 166,000 | 220,000 |

EXAMPLE 3

Figure 3:
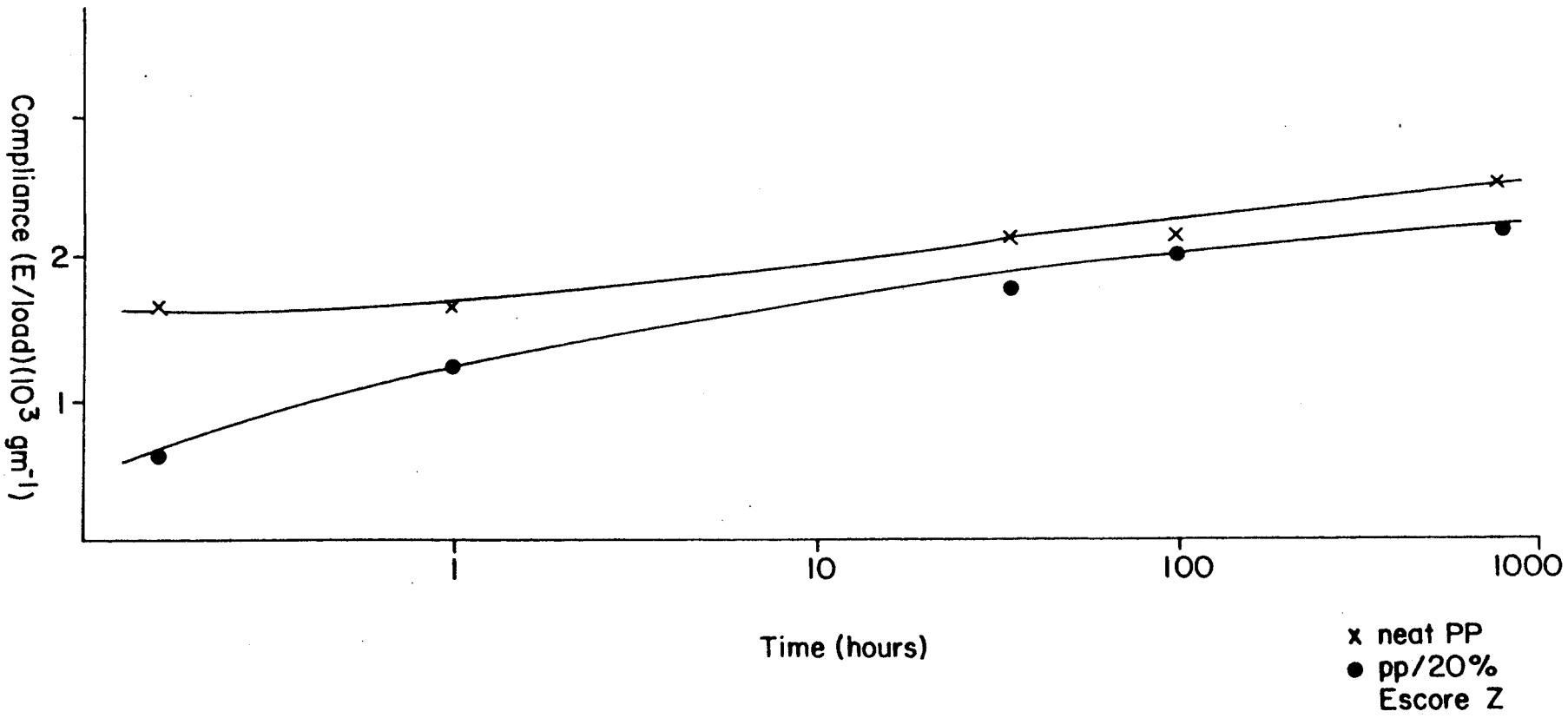
FIG. 3 is a graphical illustration of the creep compliance of oriented ribbon yarn drawn at a 7:1 draw ratio from resin-modified polypropylene (·····) compared to unmodified polypropylene (x-x-x) as described in Example 3.

The 80/20 PD020/Escorez ECR356B blend of Example 2 was prepared into ribbon yarn using the procedure of Example 1. The ribbon yarn was evaluated for creep resistance using a weight that was equal to 20% of the breaking force of the ribbon yarn at room temperature. The procedure was repeated for the PD020 polypropylene without FIG. 3 which plots the creep compliance as a function of time where the compliance is the strain e at some time divided by the stress $\sigma$ on the sample. FIG. 3 clearly shows the oriented polypropylene/ resin ribbon yarn to have lower creep compliance, i.e., greater creep resistance, relative to ribbon yarn made from the unmodified polypropylene.

The foregoing description is intended as illustrative and explanatory of the invention, and many variations on the specific description will occur to those skilled in the art. It is intended that all such variations which fall within the scope or spirit of the following claims shall be embraced thereby.

What is claimed is:

1. The use of a polypropylene blend as creep resistant textile, said blend comprising: an intimate blend of isotactic polypropylene and from 10 to 30 weight percent of a hydrogenated cyclic diolefin resin; said hydrogenated cyclic diolefin resin having a weight average molecular weight of from 500 to 1000, a glass transition temperature of from 40° C. to 90° C.; and wherein the textile exhibits creep resistance at ambient temperature and the blend has a glass transition temperature greater than 20° C., wherein the textile is formed from fiber yarn or both.

2. The textile of claim 1, wherein said blend has a melt flow ratio of from 0.1 to 10.

3. The use of the textile of claim 1 wherein the textile is woven.

4. The use of the textile of claim 1 as a fabric.

5. The use of the textile of claim 1 as a carpet staple.

6. A polypropylene resilient, creep resistance textile comprising: an intimate blend of isotactic polypropylene and from 10 to 30 weight percent of a hydrogenated cyclic diolefin resin; said hydrogenated cyclic diolefin resin having a weight average molecular weight of from 500 to 1000, a glass transition temperature of from 40° C. to 90° C.; and wherein the blend exhibits creep resistance at ambient temperature and has a glass transition temperature greater than 20° C.

* * * * *